US006105796A

United States Patent [19]

Buchanan et al.

[11] Patent Number: 6,105,796

[45] Date of Patent: Aug. 22, 2000

[54] MERCHANDISING DISPLAY LANE BLOCKER

[75] Inventors: Gregory R. Buchanan, Rock Hill; Daniel E. Hagood, Clover, both of S.C.

[73] Assignee: Eveready Battery Company, Inc., St. Louis, Mo.

[21] Appl. No.: 09/260,948

[22] Filed: Mar. 2, 1999

Related U.S. Application Data

[60] Provisional application No. 60/099,032, Sep. 3, 1998.

[51] Int. Cl.[7] ..... A47F 3/14

[52] U.S. Cl. ..... 211/128.1; 211/72; 186/59

[58] Field of Search ..... 211/128.1, 135, 211/72, 73, 55, 133.1, 126.16, 195, 134; 280/651, 79.3; 186/57, 59, 62; 312/140.4

[56] References Cited

U.S. PATENT DOCUMENTS

| | | | |
|---|---|---|---|
| D. 82,099 | 9/1930 | Marsh . | |
| D. 86,761 | 4/1932 | Brooks . | |
| D. 93,082 | 8/1934 | Wright . | |
| D. 93,083 | 8/1934 | Wright . | |
| D. 116,577 | 9/1939 | Schutz . | |
| D. 119,508 | 3/1940 | Waddell . | |
| D. 122,163 | 8/1940 | Hardy . | |
| D. 132,318 | 5/1942 | Schutz . | |
| D. 141,761 | 7/1945 | Gelinas | D80/9 |
| D. 148,767 | 2/1948 | Yantis | D80/11 |
| D. 156,544 | 12/1949 | Lebow | D80/11 |
| D. 173,627 | 12/1954 | Nichols | D80/11 |
| D. 198,611 | 7/1964 | Brach | D80/9 |
| D. 249,273 | 9/1978 | Day | D19/78 |
| D. 256,199 | 8/1980 | Burke et al. | D6/189 |
| D. 280,790 | 10/1985 | Kooy | D6/471 |
| D. 285,852 | 9/1986 | Clark | D34/21 |
| D. 287,319 | 12/1986 | Ugalde | D6/474 |
| D. 297,084 | 8/1988 | Silver | D6/476 |
| D. 305,710 | 1/1990 | Ng et al. | D6/474 |
| D. 312,717 | 12/1990 | Yau | D34/21 |
| D. 330,301 | 10/1992 | Ugalde | D6/474 |
| D. 391,420 | 3/1998 | Connor et al. | D6/473 |
| D. 394,966 | 6/1998 | Connor et al. | D6/476 |
| D. 400,030 | 10/1998 | Wetzel | 280/79.3 |
| 1,390,673 | 9/1921 | Crawford . | |
| 1,514,055 | 11/1924 | Lawson . | |
| 1,523,875 | 1/1925 | Iseman et al. . | |
| 1,534,644 | 4/1925 | Howard . | |
| 1,815,651 | 7/1931 | Fieldstein . | |
| 1,895,725 | 1/1933 | Nuckols . | |
| 1,896,721 | 2/1933 | Richards . | |
| 1,916,647 | 7/1933 | Walker . | |
| 1,947,195 | 2/1934 | Flynn | 211/156 |
| 2,034,116 | 3/1936 | Palen | 206/45 |
| 2,041,751 | 5/1936 | Folsom et al. | 248/174 |
| 2,123,290 | 7/1938 | Powers | 248/174 |
| 2,307,993 | 1/1943 | Calhoun et al. | 211/13 |
| 2,477,761 | 8/1949 | Messerschmidt | 211/137 |
| 2,506,237 | 5/1950 | Roach | 211/137 |
| 2,571,301 | 10/1951 | Slanhoff | 211/137 |

(List continued on next page.)

FOREIGN PATENT DOCUMENTS

| | | |
|---|---|---|
| 2345934 | 3/1975 | Germany . |
| 42 27 077 A1 | 2/1994 | Germany . |
| 249311 | 3/1926 | United Kingdom . |
| WO 94/19642 | 1/1994 | WIPO . |

*Primary Examiner*—Daniel P. Stodola
*Assistant Examiner*—Jennifer E. Novosad
*Attorney, Agent, or Firm*—Robert W. Welsh; Stewart A. Fraser

[57] ABSTRACT

A checkout lane blocker and merchandising display stand having a base member, a plurality of wheels located below the base member, an outer shell providing walls on top of the base member, an internal support structure disposed on the base member and including a stepped shelf, and a plurality of merchandise display trays disposed on top of the stepped shelf for holding merchandise for display. The outer shell, internal support structure, and merchandise trays are preferably made of corrugated material and the display therefore is lightweight, inexpensive, and easily recycled. The lane blocker merchandising display may be easily moved into position to block a checkout lane in a store when the checkout lane is closed.

8 Claims, 9 Drawing Sheets

U.S. PATENT DOCUMENTS

| | | | |
|---|---|---|---|
| 2,713,984 | 7/1955 | Paige | 248/174 |
| 2,723,766 | 11/1955 | Kobs | 211/128 |
| 2,801,754 | 8/1957 | Dorfman | 211/135 |
| 3,141,555 | 7/1964 | Funke et al. | 211/135 |
| 3,285,620 | 11/1966 | Mitty et al. | 280/79.3 X |
| 3,292,942 | 12/1966 | Mitty et al. | 280/79.3 X |
| 3,334,952 | 8/1967 | Brach | 312/224 |
| 3,438,508 | 4/1969 | Kuns et al. | 211/133 |
| 3,687,091 | 8/1972 | Boylan | 108/60 |
| 3,873,115 | 3/1975 | Shiflet | 280/79.3 |
| 4,164,287 | 8/1979 | Muller et al. | 211/134 |
| 4,368,804 | 1/1983 | Cole | 186/57 |
| 4,369,887 | 1/1983 | Emery | 211/133.1 |
| 4,519,319 | 5/1985 | Howlett | 108/111 |
| 4,574,863 | 3/1986 | Coleman et al. | 160/216 |
| 4,583,619 | 4/1986 | Fry | 186/59 |
| 4,605,130 | 8/1986 | Taub | 211/133.1 |
| 4,753,341 | 6/1988 | McIntyre | 206/45 |
| 4,801,023 | 1/1989 | Ecclestone | 211/55 |
| 4,991,804 | 2/1991 | Iannucci | 248/174 |
| 5,697,505 | 12/1997 | Sprague et al. | 211/13 |
| 5,711,438 | 1/1998 | Smith | 211/195 |
| 5,732,834 | 3/1998 | Wells | 211/162 |
| 5,836,455 | 11/1998 | Connor et al. | 206/757 |
| 5,848,798 | 12/1998 | Halvorson, Jr. et al. | 280/79.3 |

MERCHANDISING DISPLAY LANE BLOCKER

CROSS-REFERENCE TO RELATED APPLICATION

This application claims the benefit of U.S. Provisional Application No. 60/099,032, filed Sep. 3, 1998, the disclosure of which is incorporated herein.

BACKGROUND OF THE INVENTION

The present invention generally relates to a floor display stand for point of sale of merchandise and, more particularly, to a combination floor display stand and lane blocker that may be located in a store checkout lane to block the lane when it is closed and display merchandise for sale to consumers.

Retail shopping stores and supermarkets are typically equipped with a plurality of checkout lanes, each having a cash register adjacent to the corresponding checkout lane. Large stores are commonly configured with a large number of checkout lanes capable of handling an anticipated maximum number of customers. However, when the store is operated at less than maximum output, some of the checkout lanes are typically closed. It is not uncommon for stores to close a checkout lane by placing a closed sign in the checkout lane or connecting a chain across the lane to prevent customers from entering a closed checkout lane. The use of signs and/or chains can be considered an unattractive blocking means and results in unused floor space in the closed lane.

As an alternative to the use of signs and/or chains, a number of checkout lane blockers have been proposed. U.S. Pat. No. 5,732,834 discloses a proposed front end merchandiser with a checkout lane blocker which employs a movable display rack equipped with merchandise display devices and is movably mounted with respect to a back display rack such that the movable display rack moves from a first position where it covers the back display rack to a second position where it uncovers the back display rack and blocks the checkout lane adjacent to the merchandiser. Another proposed approach is disclosed in U.S. Pat. No. 4,574,863 which provides an isle closer apparatus adjoining a display rack in which the apparatus has a sliding panel that moves between extended and unextended positions in response to a manually actuated bar member to block or open an isle in a store. Yet another proposed approach is disclosed in U.S. Pat. No. 4,368,804 which provides for a checkout lane having a stationary shelf display and a movable shelf display that is pivotable to block the lane and includes a barrier that may slidably extend to adjust the effective width of blocking. The aforementioned proposed isle-blocking approaches require sliding or pivoting movement of an isle-blocking member which is connected to a more fixed member. This makes it difficult to easily move the conventional isle-blocker in a store. In addition, the conventional isle blockers tend to be made of materials that are generally heavy and are not easily movable.

Thus, there is a need to develop and provide retail stores with an aesthetically pleasing lane blocker which is sufficiently lightweight and easy to move. Due to increased demands by different stores for specific isle-blocking devices, there exists a need for a checkout lane blocker that is versatile for use in various locations. It is also desirable to provide for a lightweight and easy to move lane blocker that can display merchandise for sale to consumers in a retail store. More particularly, in the battery sales industry, there exists a need for a versatile isle-blocker and display stand that can accommodate battery packs of various sizes for point of sale display to consumers.

SUMMARY OF THE INVENTION

The present invention provides for a checkout lane blocker and merchandising display stand that is modular, lightweight, and easy to move into position to block a checkout lane in a store, while at the same time presenting merchandise for point of sale display to consumers. The lane blocker merchandising display stand has a base member with a plurality of wheels located below the base member. An outer shell member is assembled on top of the base member and provides at least the front and side walls and a hollow region formed between the walls. An internal support structure is disposed on top of the base member inside the hollow region to provide load bearing support. A stepped shelf is supported by the internal support structure for displaying merchandise thereon. According to a preferred embodiment, a plurality of merchandise trays are disposed on top of the stepped shelf for holding the merchandise for display. With the exception of the wheels, base member, and fasteners, the lane blocker merchandising display stand of the present invention is preferably made of corrugated material and therefore is lightweight, inexpensive, and may be easily recycled.

These and other features, advantages and objects of the present invention will be further understood and appreciated by those skilled in the art by reference to the following specification, claims and appended drawings.

DETAILED DESCRIPTION OF THE PREFERRED EMBODIMENTS

For purposes of description herein, the terms "upper," "lower," "right," "left," "rear," "front," "vertical," "horizontal," and derivatives thereof shall relate to the invention as oriented and described in FIGS. 3, 4, 15, and 16 for the assembled lane blocker merchandising display and its display trays. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
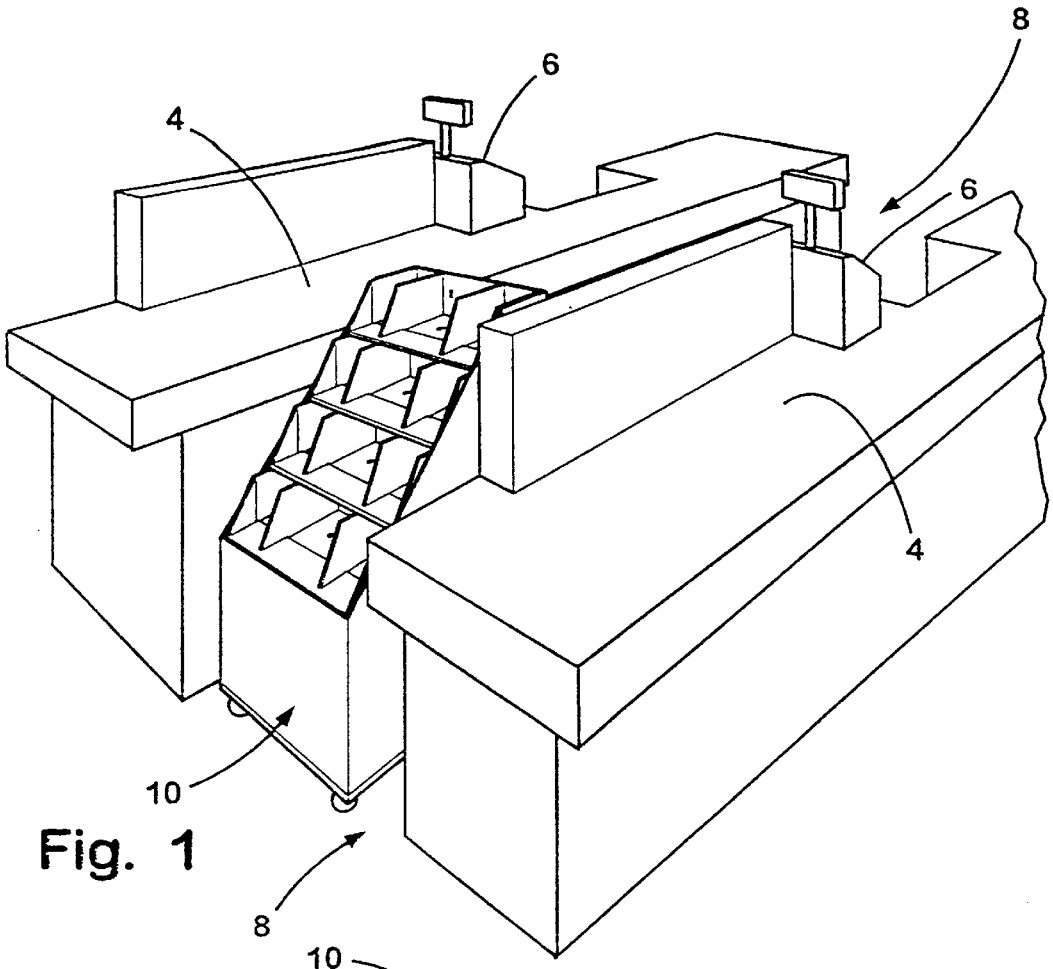
FIG. 1 is a perspective view of a lane blocker merchandising display stand according to the present invention shown located in a checkout lane of a retail store.

Turning to FIG. 1, a lane blocker merchandising display stand 10 is shown positioned in a checkout lane 8 in a retail store which is defined by the space between adjacent checkout counters 4 through which consumers normally travel to reach the cash register 6 to tender payment for the sale of merchandise to be purchased at the store. The lane blocker merchandising display stand 10 advantageously serves to block the checkout lane at a cash register when the checkout lane is intended to be closed. At the same time, the lane blocker merchandising display stand 10 advantageously utilizes the available space of the blocked lane for point of sale display of merchandise for consumers, and may further use the available space to advertise. It should be appreciated that the lane blocker merchandising display stand 10 of the present invention can be easily moved to any one of a number of checkout lanes by simply rolling the display stand 10 from one location to another.

Figure 2:
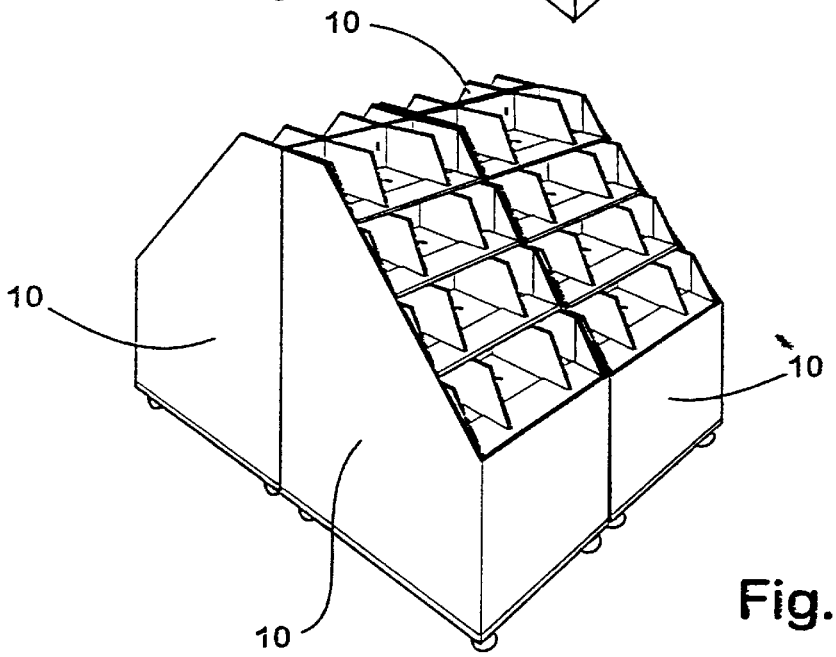
FIG. 2 is a perspective view of a plurality of lane blocker merchandising display stands located side-by-side and back-to-back to form a modular display stand arrangement.

When the lane blocker merchandising display stand 10 is not being utilized to block a checkout lane, the display stand 10 can be easily moved to display merchandise for sale to consumers at other locations in the store. Referring to FIG. 2, the merchandising display stand 10 is modular in that a plurality of lane blocker merchandising display stands 10 can be disposed together in a back-to-back and/or side-by-side arrangement to form a larger overall merchandising display stand as shown. Accordingly, when one or more checkout lanes are closed, store personnel can easily move one or more of the lane blocking display stand 10 to the appropriate closed checkout lanes to serve as a checkout lane blocker, while also displaying merchandise for sale.

Figure 3:
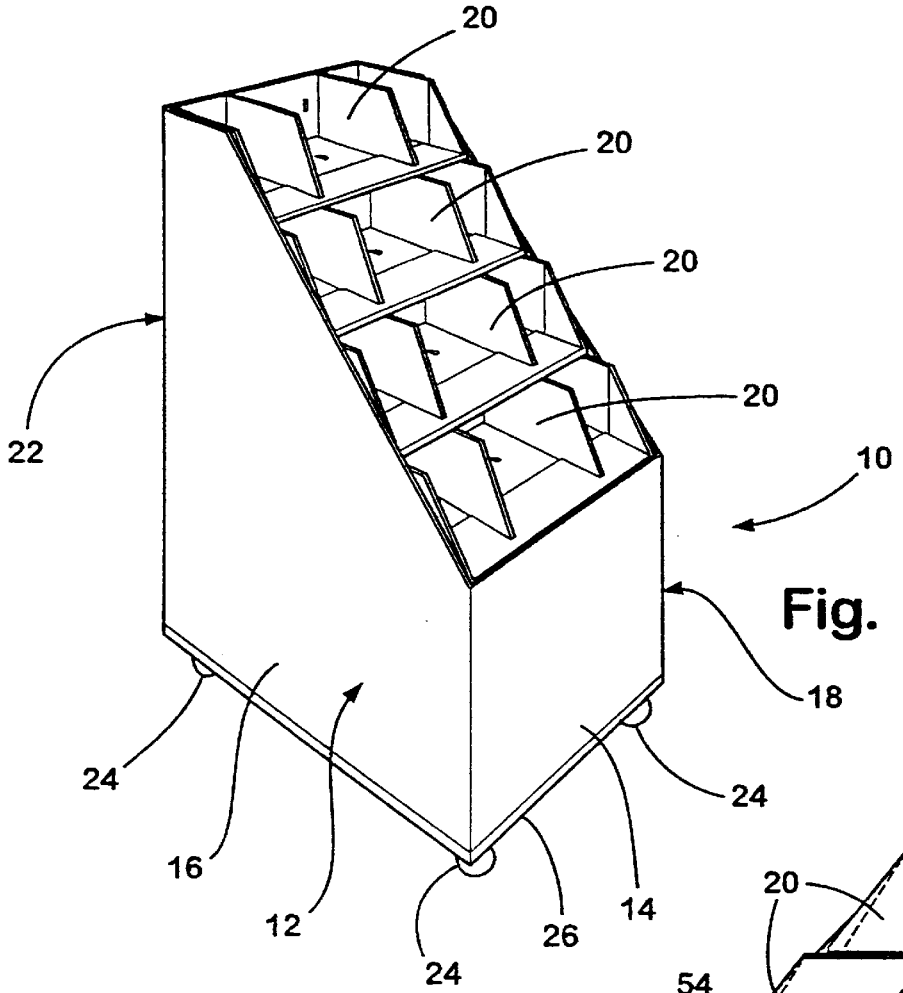
FIG. 3 is a perspective view of the lane blocker merchandising display stand.

Referring to FIG. 3, the lane blocker merchandising display stand 10 is shown having a vertically disposed outer shell 12 that wraps around the display stand to form a front wall 14, two side walls referred to as the left side wall 16 and right side wall 18 as seen from the front side, and a rear wall 22. It should be appreciated that the rear wall 22 may be integrally formed with the front and side walls as one piece of corrugated material or, alternately, may be formed as a separate piece of corrugated material. It should also be appreciated that display stand 10 could be provided without the rear wall 22, thereby providing only a front wall and two side walls. The outer shell 12 is preferably made of a lightweight corrugated material and is disposed on top of a supporting base board 26. Below base board 26 are positioned a plurality of wheels 24 which allow for easy movement of the display stand 10. Exposed near the top of the outer shell 12 are a plurality of merchandise display trays 20 which are positioned in a stepped arrangement, partially disposed one on top another. Merchandise display trays 20 hold and display product, such as batteries which are commonly packaged in blister packs, for point of sale display to consumers. The merchandise display trays 20 are preferably located at a height that is convenient for consumers to handle products displayed thereon.

Figure 4:
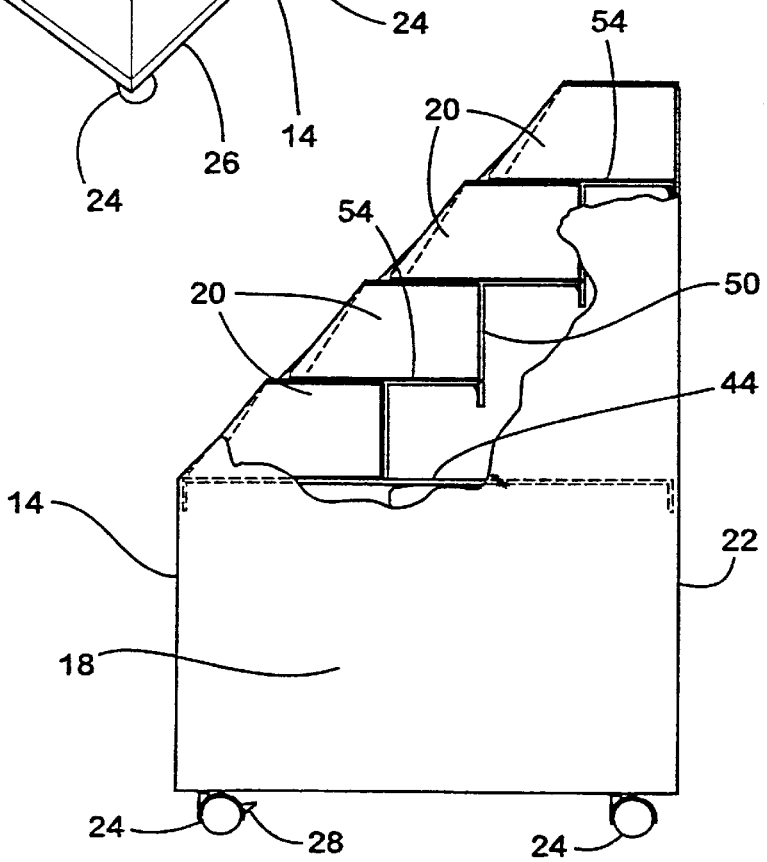
FIG. 4 is a side elevational view, partially broken away, of the lane blocker merchandising display stand in FIG. 3.

The lane blocker merchandising display stand 10 is further shown from a side view in FIG. 4. The rectangularly configured front wall 14 has a vertical height that extends lower than the vertical height of the rear wall 22. Accordingly, the side walls 16 and 18 are configured with an elevational rise from the front wall 14 toward the rear wall 22 of display stand 10. The display trays 20 are shown resting on top of both stepped shelf support 54 as well as on top of the adjacent underlying tray. The lowermost display tray 20 rests entirely on top of lower support structure cover 44 at the front side of display stand 10. The rear wheels 24 of display stand 10 pivot about the vertical axis, and preferably are freely rotatable at all times. The wheels 24 at the front side of display stand 10 likewise pivot about the vertical axis, however, the front wheels further include a locking mechanism 28 to allow for the rotational action of wheel 24 to be locked in place to prevent rotational movement of display stand 10, when desired.

Figure 5:
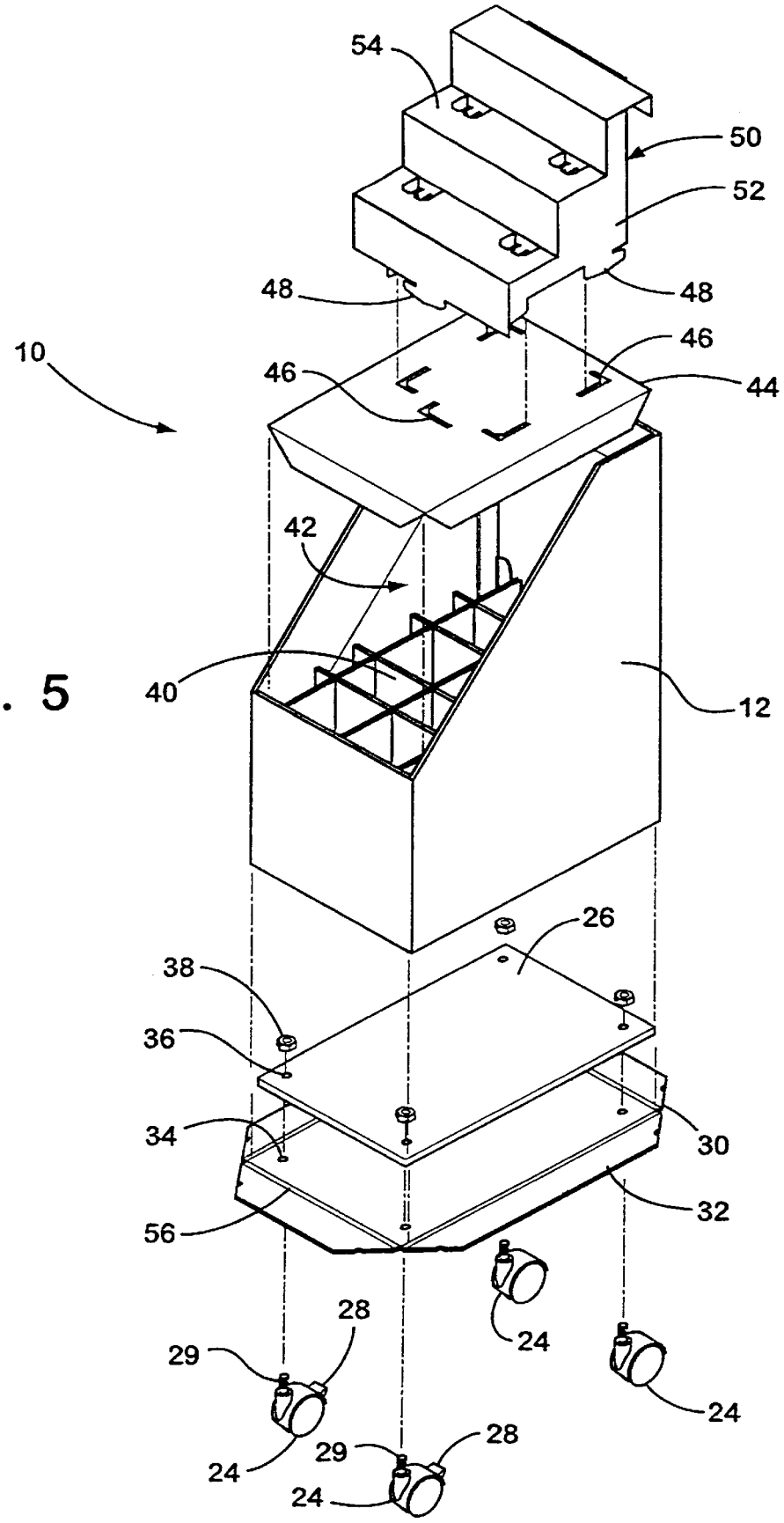
FIG. 5 is an exploded, perspective view of the lane blocker merchandising display stand absent the merchandise display trays.

Referring to FIG. 5, the assembly components of the lane blocker merchandising display stand 10 are illustrated therein. The base support member 26 is a rigid support member which is preferably made of wood, such as particle board, or other rigid support material. A base board trim cover 30 wraps underneath base board 26 and has cover flaps 32 that fold upwardly over and onto the top surface of base board 26. The cut-out blank for forming base board trim cover 30 is shown having four flaps 32 at the perimeter edges thereof which are twice foldable at double edge folds 56. The trim cover 30 folds at folds 56 both at the top and bottom edges defining the vertical width of board 26 and flaps 32 extend onto the top surface of base board 26. Each of flaps 32 are fastened by staples or other suitable fasteners on the top surface of base board 26. The base board trim cover 30 thereby sufficiently covers the bottom surface and side walls of base board 26.

Vertically extending through each of base board 26 and its trim cover 30 are four holes 36 and 34, respectively, for receiving bolts that mount each of the four wheels 24 to the bottom side of base board 26. Each of wheels 24 includes a threaded bolt 29 extending vertically upward through an aligned pair of holes 34 and 36 and matingly engaging a threaded nut 38 on top of base board 26. In addition, washers (not shown) may be disposed on top of base board 26 and below trim cover 30. Each of wheels 24 freely swivels about its vertically disposed mounting bolt 29. In addition, wheels 24 freely rotate, except when the front wheels are locked by way of locking mechanism 28.

Assembled on top of base board 26 is the outer shell 12 which is fastened to the top surface of base board 26 by way of staples or other suitable fasteners. Outer shell 12 is vertically disposed and provides the front wall 14, side walls 16 and 18, and rear wall 22. It should be appreciated that outer shell 12, as well as other assembled items of display stand 10, may include printing for product description and advertising. The outer shell 12 essentially forms a hollow region 42 surrounded by front wall 14, side walls 16 and 18, and rear wall 22. Disposed within the hollow region 42 of outer shell 12 is an internal support structure which includes an upper stepped shelf support 50, a cover 44, and a lower support structure 40 which rests directly on top of base board 26. The internal support structure is designed to withstand and transfer the weight of the trays including the weight of merchandise displayed thereon to the base board 26.

According to the preferred embodiment, disposed directly on top of the lower internal support structure 40 is the lower support structure cover 44 which is preferably made of a corrugated material. A plurality of L-shaped slots are formed in the lower support structure cover 44. The upper stepped shelf support 50 is connected in place on top of support structure cover 40 by matingly engaging locking tabs 48 with each of the L-shaped slots 46 of cover 44. The tabs 48 are inserted by bending into an L-shaped configuration to match the shape of the slot 46 and, once inserted therethrough, bending the L-shaped flap back to a straight line which locks the flap into place. The upper stepped shelf support 50 includes both a shelf side wall member 52 and a shelf cover 54 connected thereto. It should be appreciated that the bottommost merchandise display tray 20 is disposed directly on top of the lower support structure cover 44 at the front side of, while the raised or upper merchandise display trays 20 are partially disposed on top of the steps of shelf cover 54 and also rest partly on top of the next lower tray.

Figure 6:
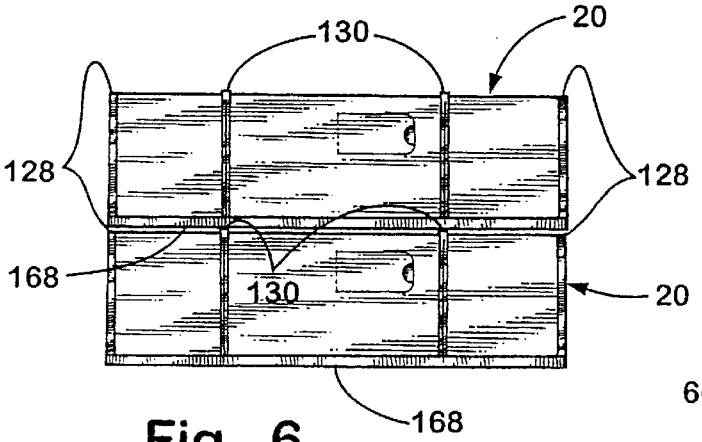
FIG. 6 is a front elevational view of the modular merchandise display trays stacked one on top of another.

It should be appreciated that the merchandise display trays 20 are preferably stacked partially one on top another, such that the weight of merchandise displayed thereon is supplied directly to both the upper stepped shelf support 50, as well as onto the next lower merchandise display tray 20, with the exception of lowest tray which rests directly on top of the lower internal support structure 40 and its cover 44. It should also be appreciated that a greater amount of weight is transferred through a central portion of the merchandising display stand 10 and away from the side walls of the display stand 10, according to the preferred embodiment. This is achieved by employing merchandise display trays 20 having weight bearing divider bars 130 that extend vertically higher than side walls 128 as shown in FIG. 6 to receive a greater portion of the load. According to this configuration, an upper merchandise display tray 20 which rests partially on top of a lower merchandise display tray 20 applies a vast majority of weight to the middle divider bars 130, as opposed to the outer side walls 128. This effectively transfers a majority, and preferably a substantial amount, of the weight from the merchandise trays 20 down through the divider bars 130 and onto the internal support structure, to the base board 26. This advantageously prevents excessive forces from being applied to the side walls of merchandise display tray 20 which might otherwise transfer to horizontal forces that could cause bulging or other adverse effects on the lane blocker merchandising display stand 10.

Figure 7:
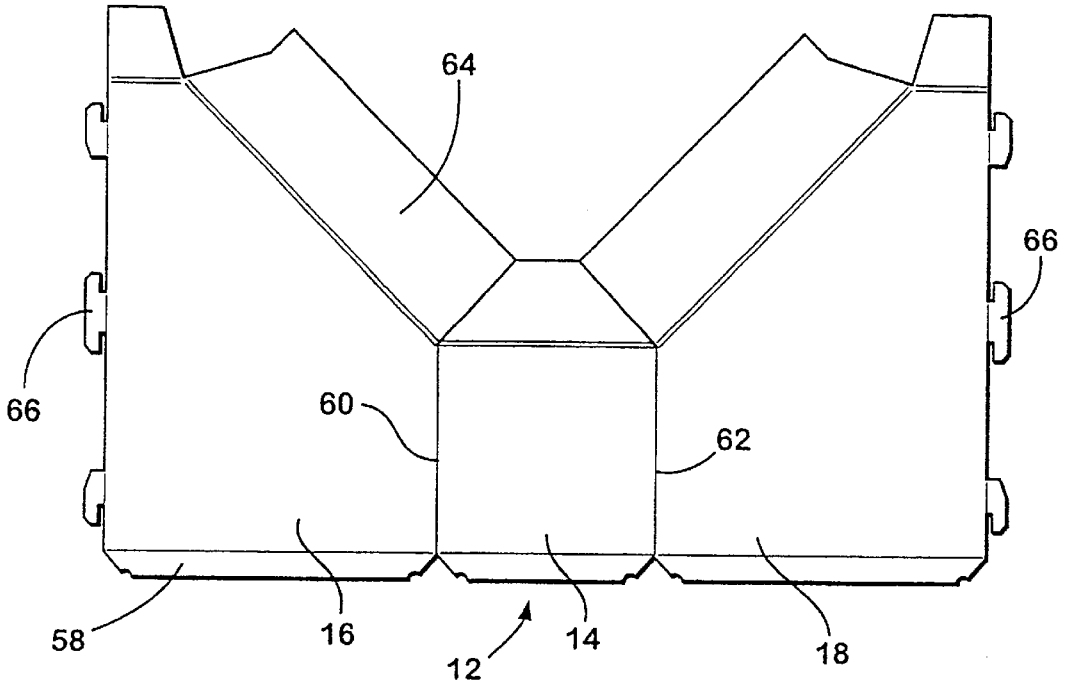
FIG. 7 illustrates a die-cut blank for forming an outer wrap shell with front and side walls of the display stand according to one embodiment.

Referring to FIG. 7, a cut-out blank for forming the outer shell 12 including the front and two side walls is illustrated therein according to one embodiment. The outer shell cut-out blank is folded ninety degrees (90°) at fold line 60 and again at fold line 62 to define left side wall 16, front wall 14, and right side wall 18. Lower flaps 58 are folded horizontally inward and are stapled or otherwise fastened onto the top of base board 26. Upper flaps 64 are folded inward and down into the hollow region 42. Also included are both L-shaped and T-shaped locking tabs 66 which are provided to matingly engage with the rear wall 22 of lane blocker merchandising display stand 10 according to the first embodiment. Together, the front wall 14, side walls 16 and 18, and rear wall 22 form outer shell 12 when assembled together.

Figure 8:
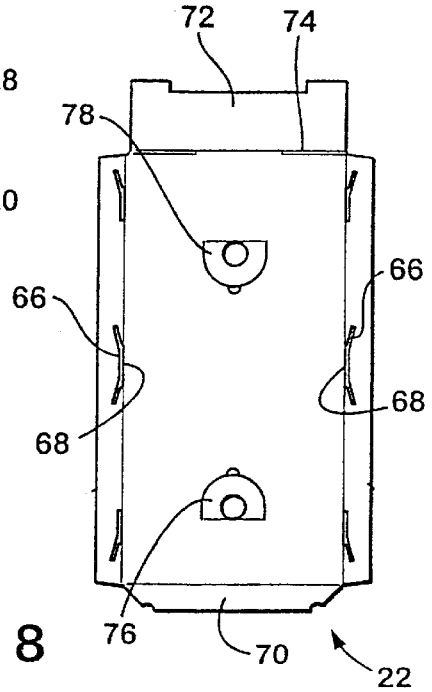
FIG. 8 illustrates a die-cut blank for forming the rear wall of the display stand according to one embodiment.

The rear wall 22 of display stand 10 is shown in FIG. 8 as a separate sheet according to the first embodiment and having locking tabs 66 matingly engaged into slots 68 formed in rear wall 22. Accordingly, locking tabs 66 can be easily attached to engage and lock the rear wall 22 into place with the side walls, and can also easily be disengaged to break down the display stand 10 into a compact and easy to ship assembly. Also included at the bottom of the rear wall blank is lower flap 70 which is folded inward to a horizontal position and preferably stapled or otherwise fastened to the top surface of base board 26, and at the top is an upper flap 72 which is folded inward and downwardly into the hollow region 42. The rear wall 22 is also equipped with one or more horizontal slots 74 formed in the top portion thereof for receiving an optional display sign that may be mounted thereon. In addition, a pair of electrical wire guides 76 and 78 are adapted to receive electrical wiring for supplying lighting to any optional display mounted thereon. Wire guides 76 and 78 may be formed with perforations in the rear wall 22 such that a user can pull out the wire guides 76 and 78, when needed.

According to a second embodiment, the outer shell 12 may be formed of a single piece of corrugated material by providing the front wall 14, side walls 16 and 18, and rear wall 22 from one cut-out blank. According to the second embodiment, the outer shell 12 has the rear wall 22 integrally formed as part of the cut-out blank in which the rear wall 22 is folded ninety degrees from one side wall and is glued or otherwise fastened to the other side wall, preferably near one of the rear comers. Accordingly, the rear wall 22 may be integrally formed with the side walls and front wall, or alternately, may be a separate attachable assembly piece.

Figure 9:
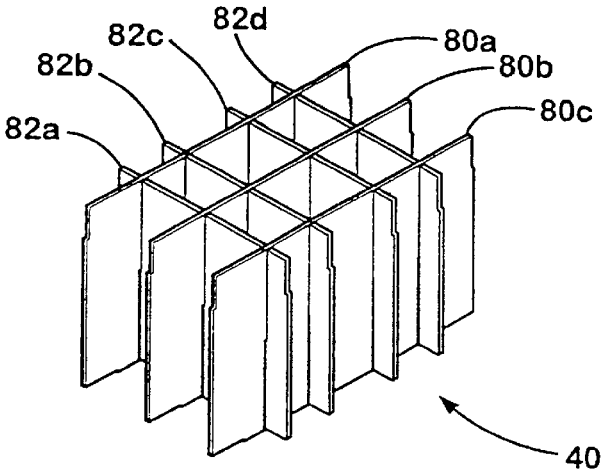
FIG. 9 is a perspective view of a lower internal support structure for bearing load on the merchandising display stand.
Figure 10:
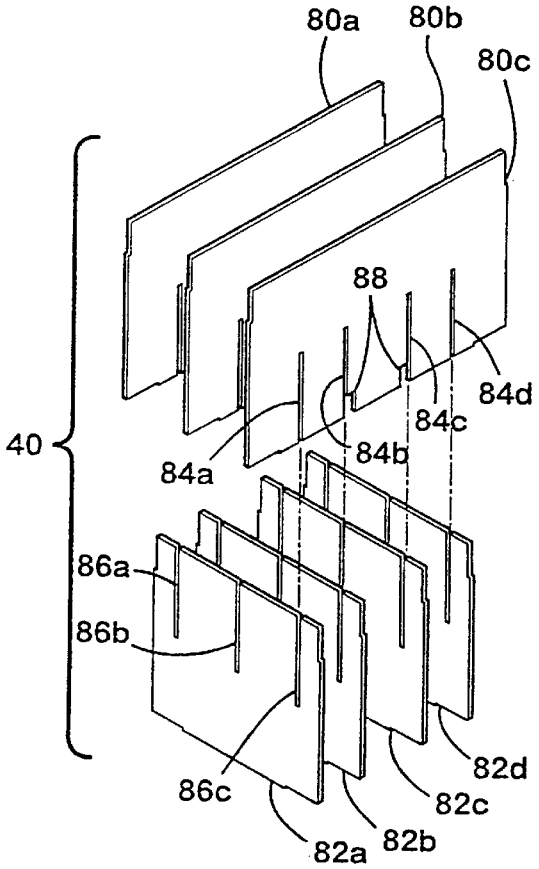
FIG. 10 is an exploded view of the lower internal support structure of FIG. 9.

The lower internal support structure 40 is shown in FIGS. 9 and 10 made up of vertically disposed orthogonal support members which are made of corrugated material. According to the embodiment shown, three parallel longitudinal support members 80*a*–80*c* are formed each having four vertical slots 84*a*–84*d* which extend partially upwardly therethrough into each longitudinal support member from the bottom side. Four parallel laterally disposed support members 82*a*–82*d*, which are disposed perpendicular to the longitudinal support members 80*a*–80*c*, are each provided with three slots 86*a*–86*c* extending partially downward therethrough from the top surface. The longitudinal and lateral support members 80*a*–80*c* and 82*a*–82*d* are interconnected such that each of the lateral support members 82*a*–82*d* are disposed in slots 84*a*–84*d*, while each of the longitudinal support members 80*a*–80*c* are disposed in slots 86*a*–86*c* to form a crate-like lower support structure 40. In addition, lateral support members 80*a*–80*c* each includes two additional widened slots 88 which allow the upper stepped shelf support 50 to be mounted thereon so that tab 48 of shelf cover 54 may extend into one of the widened slots 88.

Figure 11:
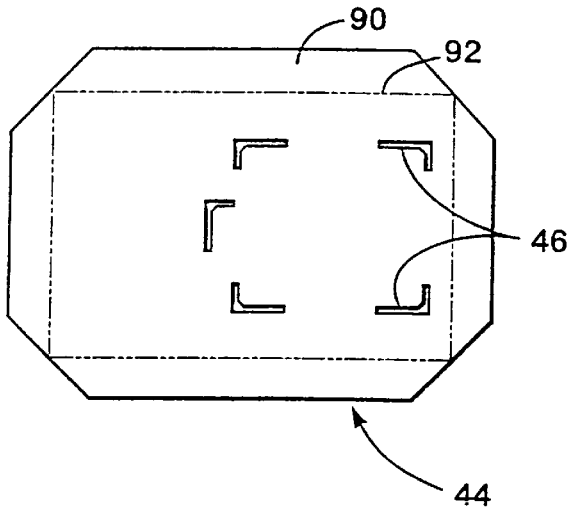
FIG. 11 illustrates a die-cut blank for forming the support structure cover.

Referring to FIG. 11, the cut-out blank for framing the lower support structure cover 44 is shown having a plurality of flaps 90 provided at the peripheral edges thereof which fold about fold line 92. Each of flaps 90 are intended to fold vertically down along the outside of the internal support structure 40 such that the top of lower internal support structure 40 is covered by cover 44. Formed through the surface of cover 44 are five L-shaped slots 46 for matingly engaging tabs 48 of upper shelf support 50.

Figure 12:
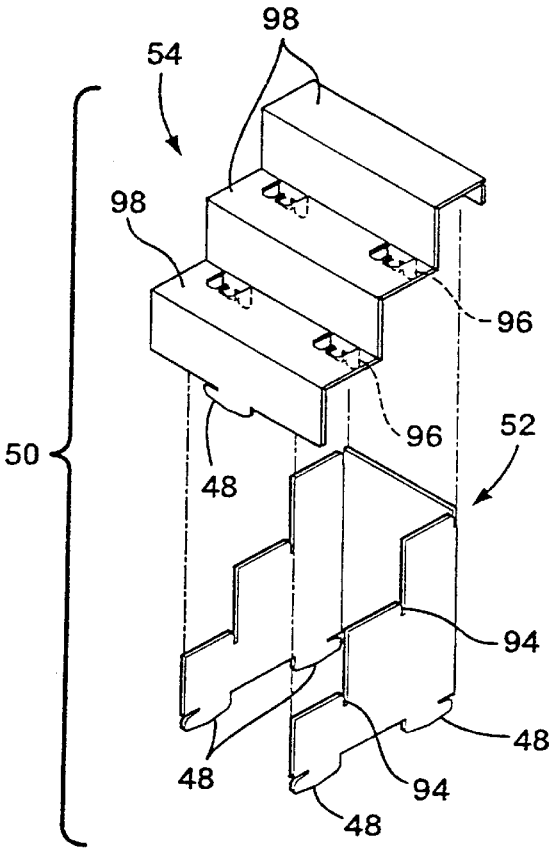
FIG. 12 is an exploded view of an upper stepped shelf support.
Figure 13:
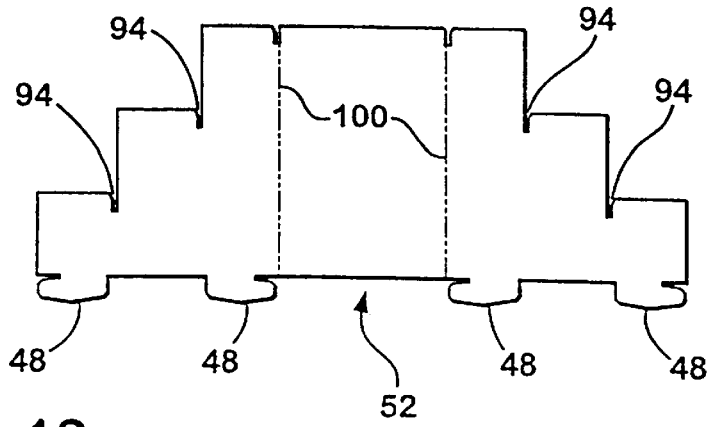
FIG. 13 illustrates a die-cut blank for forming the shelf side walls of the upper stepped shelf support.
Figure 14:
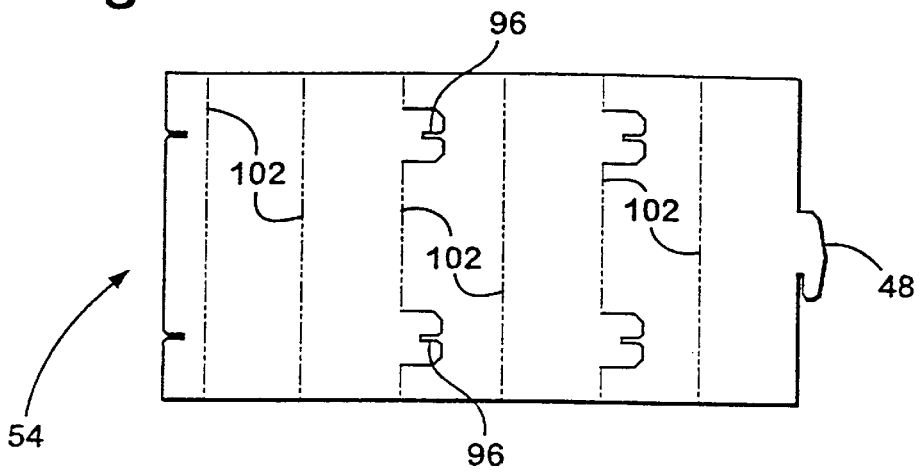
FIG. 14 illustrates a die-cut blank for forming a shelf cover of the upper stepped shelf support.

The upper stepped shelf support 50 is shown in greater detail in FIG. 12. The upper stepped shelf support 50 includes shelf side walls 52 which are formed of a cut-out blank such as shown in FIG. 13. The shelf side walls 52 include left and right side walls each having receiving channels 94 at each step, and a rear wall provided between the side walls as defined by fold lines 100. The shelf side walls 52 include four tabs 48 for engaging L-shaped slots 46 in the lower support structure cover 44. Disposed on top of the shelf side walls 52 is the shelf cover 54 which is made of a cut-out blank as shown in FIG. 14. The shelf cover 54 includes a bottom tab 48 which engages the frontmost one of the L-shaped slots in cover 44. In addition, each of the three steps of shelf cover 54 has a pair of tabs 96 disposed vertically downward for engaging the receiving channels 94 of the shelf side walls 52, so as to connect the shelf side walls 52 to the shelf cover 54. Shelf cover 54 includes a number of fold lines as indicated by 102 for shaping the shelf cover 54 into the three-step configuration.

Referring to FIGS. 15–20, the preferred modular merchandise display tray 20 is shown, which is employed with the lane blocker merchandising display stand 10 of the present invention, and illustrates its various components. One example of such a merchandise display tray is disclosed in U.S. Pat. No. 5,836,445, entitled "FLOOR DISPLAY ASSEMBLY," which is hereby incorporated by reference.

Figure 15:
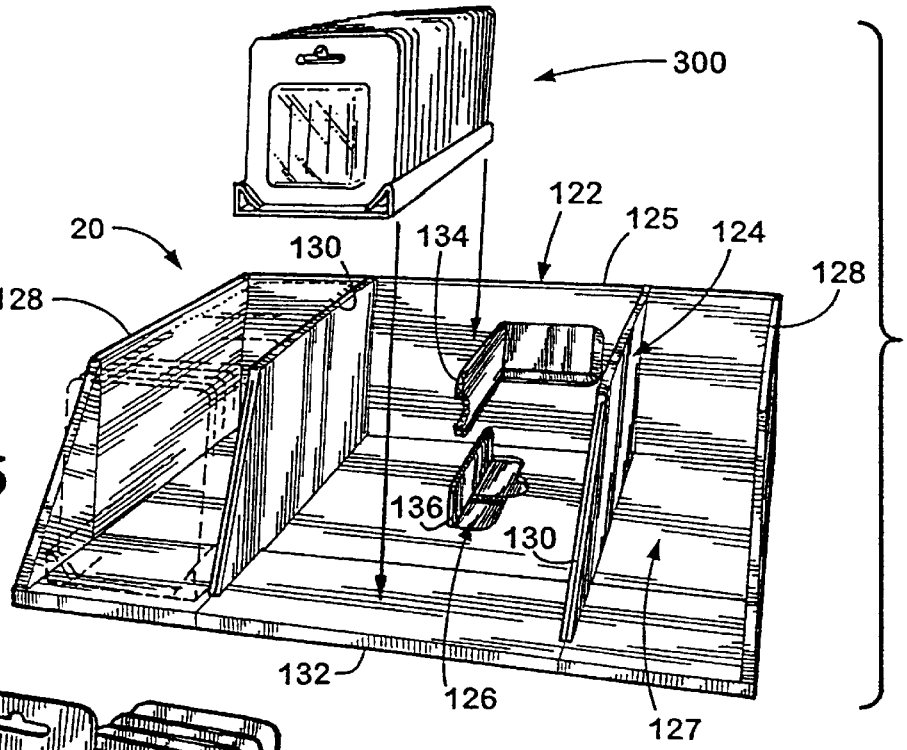
FIG. 15 is a perspective view of a merchandising display tray of the merchandising display stand, wherein blister pack trays are shown inserted in the display tray.
Figure 21:
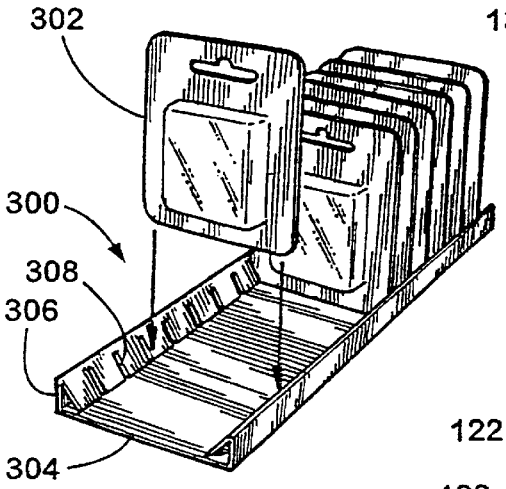
FIG. 21 is a perspective view of a blister pack tray showing the arrangement and retention of individual blister packs therein.
Figure 16:
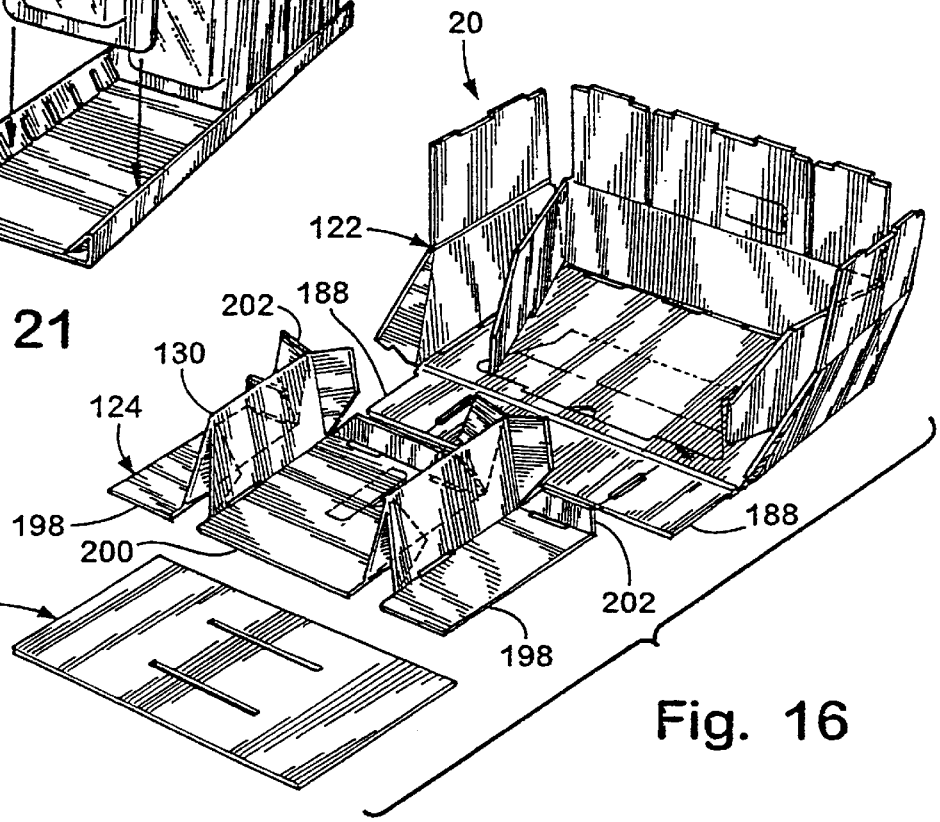
FIG. 16 is an exploded, perspective view of a display stand tray showing the die-cut blanks in a partially folded configuration.

Merchandise display tray 20, most easily seen in FIGS. 15 and 16, includes a folded outer shell member 122 which receives stiffener panel 126 and folded inner divider member 124 to form the completed display stand tray 20. In its final assembled form, display stand tray 20 comprises bottom support panel 127, a pair of upstanding end walls 128 and a back wall 125 integral with bottom support panel 127. A pair of upstanding, interior structural walls 130 are positioned interior of end walls 128 and horizontally positioned therefrom to form channels therebetween. The channels being sized to receive the product for sale and for displaying the same, typically individual trays of blister or clam pack batteries, such as tray 300. As previously described, interior structural walls 130 preferably extend vertically higher than end walls 128, and preferably higher than back wall 125, such that interior walls 130 receive a substantial amount of weight placed on top thereof by trays stacked on top. Tray 300, which forms no part of the instant invention, typically comprises a bottom 304 with triangular support sides 306 having a series of laterally spaced apart slots 308 for receiving individual blister packs 302. Completed blister pack trays 300 are readily insertable and removable from the channels formed by upstanding walls 128 and 130. Display tray 20 typically has at least one pair of adjacent walls 128 or 130 which are positioned to receive at least two rows of merchandise product or blister pack trays 300 therebetween. At least one divider tab 134, integral to and die-cut from back wall 125 is movable from a first position flush with back wall 125 to a second position wherein divider tab 134 lies in a vertical plane parallel to walls 128 and 130. Divider tab 134 is positioned to separate blister pack trays 300 and to prevent merchandise product from shifting from one side to the other. A second divider tab 136 is integral to and die-cut from bottom support panel 127 and is movable from a first position flush with bottom support panel 127 to a vertical position wherein second tab 136 is substantially parallel with walls 128 and 130 and in substantially vertical alignment with divider tab 134. Because blister pack trays 300 for different sized batteries have different lengths, loose blister packs may be inserted between the end of the blister pack trays 300 and the back wall. Second divider tab 136 functions to prevent single blister packs 302 from laterally shifting within the lateral space described by interior support walls 130. Absent the divider tabs, smaller sized battery packs, such as four-packs of AAA-sized batteries would shift between the inner two channels. By providing a combination of two divider tabs, a dividing mechanism may be provided that optionally extends well out in-between the channels for one configuration and that may be conveniently moved into a flush position for another configuration.

In the preferred embodiment, display tray 20 is formed from corrugated cardboard, including outer shell member 122, inner divider member 124, and stiffener panel 126. However, it will be understood by those skilled in the art that the various members of display tray 20 may be formed of paperboard including cardboard and corrugated cardboard or any other substantially rigid material.

Figure 20:
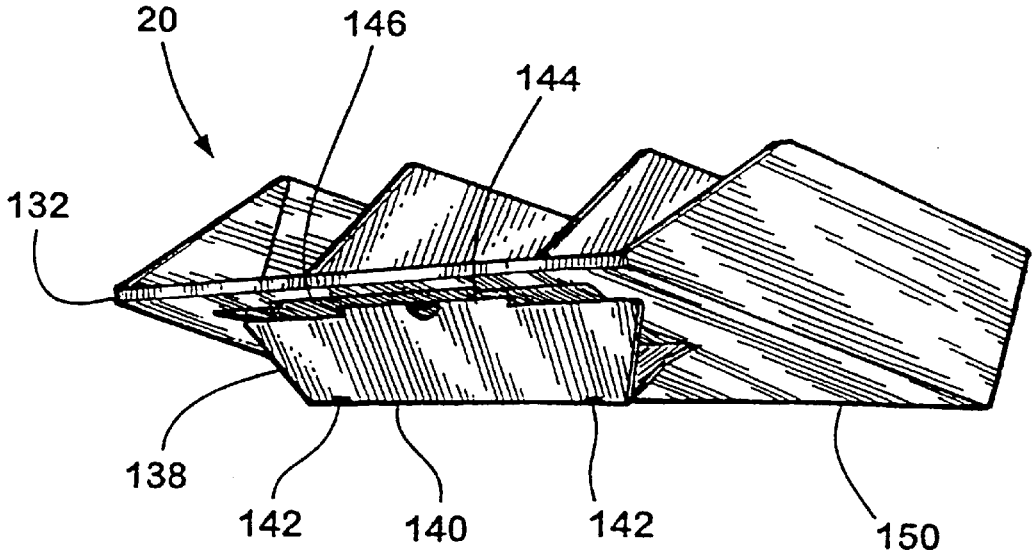
FIG. 20 is a bottom perspective view of the display tray showing the support tray in a deployed configuration.

Referring now to FIG. 20, merchandise display tray 20 is shown with a support stand 138 which is integral to and die-cut from the bottom support panel 127. Support stand 138 is movable from a first position flush with bottom support panel 127 to a second position wherein support stand 138 projects downwardly to elevate front edge 132 of bottom support panel 127 above the rear edge 150 of bottom support panel 127. When support stand 138 is in a deployed configuration, support stand 138 forms a V-shape wherein the apex 140 of the V-shape is parallel with rear edge 150 of bottom support panel 127. Apex 140 also has recesses 142 substantially in vertical alignment with interior structural walls 130 which engage the interior walls of a tray therebelow to minimize the possibility of lateral shifting between the two trays. Support stand 138 functions to support a front portion of display tray 20 in an elevated position above a rear portion of tray 20 thereby angling the channels containing the blister packed product more along the view line of a purchaser than if the display tray were placed on a horizontal surface in an unelevated position. Further, by angling the bottom surface back in the manner illustrated, the need for an elevated front lip may be eliminated since the battery packs are less likely to fall out of the tray. By eliminating the need for a front lip, which tends to obscure the customers' view of the products, one may provide a display tray that maximizes the visibility of the product. The use of divider tabs 134 and 136 rather than another full partition wall, also increases product visibility.

Figure 17:
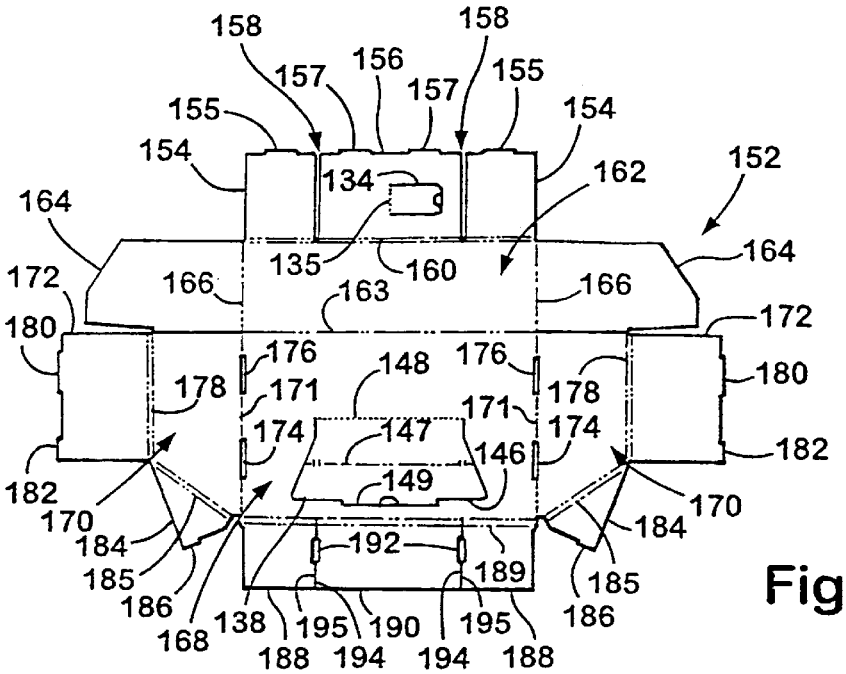
FIG. 17 illustrates a die-cut blank of the outer shell member of the tray.

Turning now to FIG. 17, an outer shell die-cut blank is shown generally at 152. Blank 152 includes a bottom panel 168, a rear panel 162, and two outer end panels 170. Panels 162 and 170 are joined to bottom panel 168 along fold lines 163 and 171, respectively. Joined to rear panel 162 are end panels 164. End panels 164 are joined to the left and right lateral ends of rear panel 162 along fold line 166. Also joined to rear panel 162 are outer back wall segments 154 and middle back wall segment 156. Back wall segments 154 and 156 are in lateral alignment and are joined to rear panel 162 along a top edge of rear panel 162 at fold line 160. Outer back wall segments have a tab 155 positioned along an upper edge of segment 154 opposite from fold line 160. Similarly, middle back wall segment has two tabs 157 positioned along an upper edge opposite fold line 160. Divider tab 134 is die-cut in an intermediate interior portion of middle back wall segment 156. Divider tab 134 is generally rectangular in shape and cut along three of the four sides of tab 134. The fourth side being joined to middle back wall segment 156 at fold line 135. Fold line 135 is positioned approximately midway between the lateral ends of middle back wall segment 156. Outer back wall segments 154 are laterally spaced from middle back wall segment 156 thereby forming slots 158 between segments 154 and 156. The width of slot 158 is approximately the thickness of interior structural wall 130 and in alignment therewith.

Joined to outer end panels 170 are inner end panel 172 and inner triangular panels 184. Inner end panel 172 is joined to outer end panel 170 at fold line 178 and inner triangular panel 184 is joined to outer end panel 170 at angled fold line 185. Inner end panels 172 have tabs 180 and 182 positioned at the outer lateral edges thereof and inner triangular panel 184 has tab 186 positioned at a lower outer edge thereof. Angle fold line 185 and inner triangular panel 184 are dimensioned such that when folded in a final assembled configuration as shown in FIG. 15, tray 20 possesses end walls 128 having forward edges which are clearly and uniformly angled away from a potential purchaser and wherein inner end panel 170 is in an end-to-end abutting relationship with triangular panel 184.

Outer front segments 188 and inner front segment 190 are joined to bottom panel 168 at a bottom edge thereof at fold line 189. Segments 188 and 190 are separate at cut line 194 with apertures 192 positioned therealong thereby forming tabs 195 at the inner lateral edges of segments 188 and the outer lateral edges of segment 190.

Positioned in an interior intermediate portion of bottom panel 168 is support stand 138. Support stand 138 is generally trapezoidal in shape with the major base being positioned most proximate to the lower edge of bottom panel 168 and the minor base being positioned approximately mid-height of bottom panel 168. Support stand 138 is die-cut around three sides of the trapezoidal shape with support stand 138 being joined to bottom panel 168 at fold line 148 which corresponds to the minor base of the trapezoid. Support stand 138 when disengaged from bottom panel 168 has free end 146 with support stand tab 149 positioned intermediate therealong. Fold line 147 is positioned parallel to and intermediate between free end 146 and fold line 148. Bottom panel 168 has positioned at its outer lateral edges thereof and along fold line 171, front slots 174, and rear slots 176. Slots 174 and 176 being vertically aligned with tabs 180 and 182 on inner end panels 172.

Figure 18:
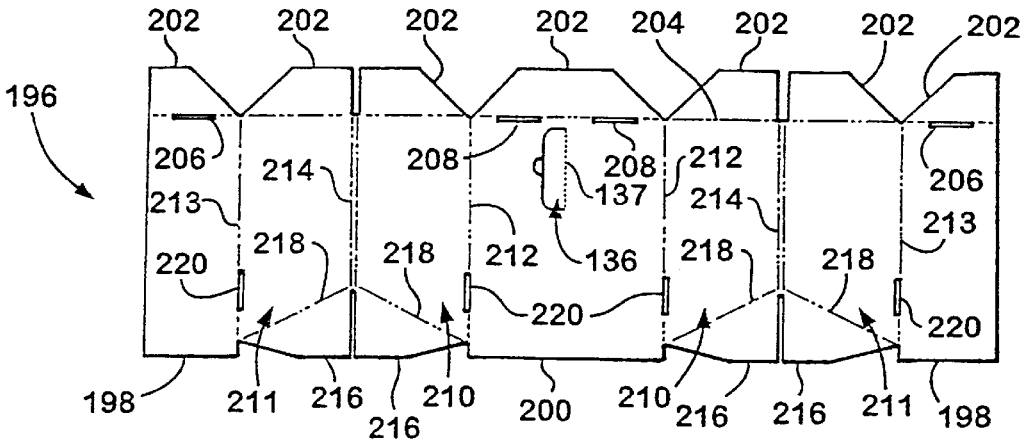
FIG. 18 illustrates a die-cut blank of the inner divider member of the tray.

It will be noted by those skilled in the art, that fold lines 160, 178, 185, and 189 in FIG. 17 and fold line 214 in FIG. 18 are double fold lines which, when the various die-cut blanks are folded therealong, form a uniform plate-like appearance to elements of the final assembled tray which are folded one-hundred-eighty degrees into a self-abutting relationship.

Turning now to FIG. 18, inner divider die-cut blank is shown generally at 196. Blank 196 includes an inner support panel 200, interior wall panels 210 and 211, and outer support panels 198. One of each interior wall panels 210 are joined to each of the lateral edges of inner support panel 200 along bend line 212, and one of each of interior wall panel 211 is joined to the interior wall panels 210 in a mirror image fashion along fold line 214. Outer support panels 198 are joined to the outer lateral edge of interior wall panels 211 at fold lines 213. Rear flaps 202 are joined to outer support panels 198, inner support panel 200, and interior wall panels 210 and 211 at their respective upper edges thereof at fold line 204. Slots 206 project through outer support panels 198 along fold line 204 and are substantially laterally centered along the width of outer support panels 198. Two slots 208 also project through inner support panel 200 at an upper edge thereof along fold line 204. Slots 208 being intermediately spaced between the lateral edges of inner support panel 200. Front flaps 216 are joined to interior wall panels 210 at a bottom portion thereof along angled fold line 218. The angle of fold line 218 and the geometry of front flap 216 is such that when display stand tray 20 is finally assembled, interior support wall 130 as shown in FIG. 15 formed by interior wall panels 210 has a forward edge which is substantially parallel to the angled forward edge of end walls 128.

Figure 19:
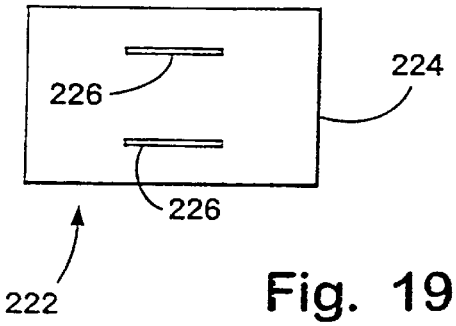
FIG. 19 illustrates a die-cut blank of the stiffener panel of the tray.

FIG. 19 shows stiffener panel die-cut blank designated generally at 222. Blank 222 generally comprises panel 224 which is typically of a thick corrugated cardboard to provide additional support and strength to bottom support panel 127 thereby aiding in the shipping and stacking of filled display trays 20 with blister pack trays 300. Two slots 226 parallel to and each equi-distant from a corresponding adjacent major base of rectangular panel 224 project through panel 224 such that blank 222 is symmetrical about a vertical central axis and about a horizontal central axis thereby forming stiffener panel 226 as shown in FIG. 16. With reference to FIGS. 15 and 16, the symmetry of panel 126 facilitates ease of assembly of display stand tray 20 in that panel 126 may be inserted into outer shell member 122 in either of two orientations without affecting the functionality of display stand tray 20.

With reference to FIGS. 16–19 to assemble display tray 20, outer shell die-cut blank 152 is folded to form outer shell member 122. End panels 164 are folded up approximately ninety degrees along fold line 166 and rear panel 162 is then folded up ninety degrees with respect to bottom panel 168 along fold line 163. Outer end panels 170 are folded up approximately ninety degrees with respect to bottom panel 168 such that end panels 164 are interior to and in an abutting relationship with outer end panels 170. Inner end panels 172 are then folded down approximately one-hundred-eighty degrees (180°) along double fold line 178 until tabs 180 and 182 are engaged in slots 176 and 174, respectively. Inner triangular panels 184 are folded inwardly along double fold line 185 until partial tabs 186 are also engaged in slots 174.

Stiffener panel die-cut blank 222 (stiffener panel 126) is placed interiorly of partially assembled outer shell member 122 to rest on an upper surface of bottom panel 168. Slots 226 being parallel to fold line 189 of die-cut blank 152.

Turning now to inner divider die-cut blank 196, rear flaps 202 are folded up approximately ninety degrees along fold line 204. Front flaps 216 at the lower end of interior wall panels 210 are folded down and back one-hundred-eighty degrees (180°) along fold line 218. Interior wall panels 210 joined to inner support panel 200 are folded up ninety degrees along fold lines 212, and outer interior wall panels 211 are folded down one-hundred-ninety degrees along double fold lines 214. Inner and outer interior wall panels 210 and 211 combine when abutted after folding to form interior structural walls 130. Outer support panels 198 are folded up ninety degrees along fold line 213 to complete the forming of inner divider member 124 as shown in FIG. 16.

Folded inner divider member 124 is placed interiorly of partially folded outer shell member 122 such that rear flaps 202 abut rear panel 162, and outer and inner support panels 198 and 200 rest on an upper surface of stiffener panel 126. Outer and middle back wall segments 154 and 156 of outer shell member 122 are folded down one-hundred-eighty degrees along double fold line 160 until tabs 155 and 157 are captured and retained by slots 206 and 208 respectively in inner divider member 124. Outer and middle front segments 188 and 190 of outer shell member 122 are folded up and back along double bend line 189 until tabs 195 are captured and retained by slots 220 in inner divider member 124; thus, producing finished display stand tray 20. By folding front segments 188 and 190 over the front edge of the tray, additional reinforcement is provided at the front of the tray to prevent racking.

Divider tab 134 can be disengaged from its flush position in back wall 125 and bent forwardly ninety degrees along fold line 135 to position divider tab 134 to affect separation of individual blister packs 302. Similarly, second divider tab 136 may be disengaged from its flush position in bottom support panel 127 and folded up ninety degrees along fold line 137 to promote separation of individual blister packs 302.

Display stand trays 20 may be utilized with support stand 138 in either an engaged or non-engaged position. In its non-engaged position, support stand 138 remains flush with the lower surface of bottom support panel 127. To deploy support stand 138, support stand free end 146 is disengaged from the lower surface of bottom support panel 127 and bent down approximately forty-five degrees along fold line 148 and then folded up approximately ninety degrees along fold line 147. Removal of support stand 138 from its flush position exposes slot 226 in stiffener panel 126 so that it may receive tab 149 of support stand 138. Insertion of tab 149 in slot 226 retains support stand 138 in an engaged position for supporting a forward portion of display stand tray 20.

In use, display stand tray 20 may also be used singularly for displaying product on any horizontal shelf or counter top whereby display stand 138 may be utilized to elevate front edge 132 of display stand tray 20 above rear edge 150 for angling the product more along the view line of a purchaser.

The lane blocker merchandising display stand 10 of the present invention may be formed substantially of corrugated cardboard without requiring any additional pieces, clamps, or clips of any other material with the exception of base board 26, wheels 29, and associated fasteners. Thus, a substantial amount of the structure may be recycled. While many of the components making up the lane blocking merchandising display stand 10 are preferably made of corrugated cardboard, it should be appreciated that other suitable materials may be employed without departing from the spirit of the claimed invention.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

What is claimed is:

1. A movable lane blocker merchandising display stand comprising:

a base member;

a plurality of wheels located under said base member to allow movement of said lane blocker merchandising display stand;

an outer shell supported by said base member and having front and side walls and forming a hollow region between said walls;

an internal support structure disposed within said hollow region and comprising a plurality of shelves in a stepped configuration positioned between said side walls and supported by said base member; and a plurality of merchandise trays disposed on said shelves for holding said merchandise to be displayed, wherein at least some of said plurality of trays are supported at least partially by said shelves and are further supported by another of said trays disposed therebelow, wherein each of said plurality of trays comprises one or more vertically disposed support members situated between outer side walls.

2. A movable lane blocker merchandising display stand comprising:

a base member;

a plurality of wheels located under said base member to allow movement of said lane blocker merchandising display stand;

an outer shell supported by said base member and having front and side walls and forming a hollow region between said walls;

an internal support structure disposed within said hollow region and comprising a plurality of shelves in a stepped configuration positioned between said side walls and supported by said base member;

a plurality of merchandise trays disposed on said shelves for holding said merchandise to be displayed;

at least some of said plurality of trays are supported at least partially by said shelves and are further supported by another of said trays disposed therebelow; and each of said plurality of trays comprises one or more vertically disposed support members situated between outer side walls, wherein said one or more vertically disposed support members have a height extending vertically higher than a height of said outer side walls.

3. A movable lane blocker merchandising display stand comprising:

a base member;

a plurality of wheels located under said base member to allow movement of said lane blocker merchandising display stand;

an outer shell supported by said base member and having front and side walls and a hollow region between said walls;

an internal support structure disposed within said hollow region and resting on top of said base member; and a plurality of merchandise trays supported by said internal support structure for holding merchandise for display, wherein the merchandise trays are supported by the internal support structure having a plurality of shelves in a stepped configuration for holding said plurality of merchandise trays, and at least some of said plurality of trays are supported at least partially by said shelves and are further supported by another of said trays disposed therebelow, and wherein each of said plurality of trays comprises one or more vertically disposed support members situated between outer side walls.

4. A movable lane blocker merchandising display stand comprising:

a base member;

a plurality of wheels located under said base member to allow movement of said lane blocker merchandising display stand;

an outer shell supported by said base member and having front and side walls and a hollow region between said walls;

an internal support structure disposed within said hollow region and resting on top of said base member;

a plurality of merchandise trays supported by said internal support structure for holding merchandise for display, wherein the merchandise trays are supported by the internal support structure in a stepped configuration;

said internal support structure comprises a plurality of shelves for holding said plurality of merchandise trays;

at least some of said plurality of trays are supported at least partially by said shelves and are further supported by another of said trays disposed therebelow; and each of said plurality of trays comprises one or more vertically disposed support members situated between outer side walls, wherein said one or more vertically disposed support members has a height extending vertically higher than a height of said outer side walls.

5. A movable lane blocker merchandising display stand comprising:

a base member;

a plurality of wheels located under said base member to allow movement of said lane blocker merchandising display stand;

an outer shell supported by said base member and having front and side walls and forming a hollow region between said side walls;

an internal support structure disposed within said hollow region and having vertically disposed members made of corrugated material, said internal support structure comprising a plurality of shelves in a stepped configuration positioned between said side walls and supported by said base member for supporting merchandise to be displayed thereon; and a plurality of merchandise trays disposed on said shelves for holding said merchandise to be displayed, at least one of said plurality of merchandise trays having one or more vertically disposed support members situated between outer side walls of said tray for supporting load placed thereon, wherein at least some of said plurality of trays are supported at least partially on said shelves and are further supported by another of said trays disposed therebelow.

6. The lane blocker merchandising display stand as defined in claim 5, wherein each of said plurality of merchandise trays is made of corrugated material.

7. A movable lane blocker merchandising display stand comprising:

a base board:

a plurality of wheels located under said base board to allow movement of said lane blocker merchandising display stand;

an outer shell supported by said base board and having front and side walls and forming a hollow region between said walls, said outer shell being made of corrugated material;

an internal support structure disposed within said hollow region and having vertically disposed members made of corrugated material, said internal support structure comprising a plurality of shelves in a stepped configuration positioned between said side walls and supported by said base board for supporting merchandise to be displayed thereon, said plurality of shelves being made of corrugated material; and a plurality of merchandise trays disposed on said shelves for holding said merchandise, each of said plurality of merchandise trays being made of corrugated material, wherein at least some of said plurality of merchandise trays are supported at least partially by said shelves and are further supported by another of said merchandise trays disposed therebelow, and wherein at least one of said plurality of merchandise trays comprises one or more vertically disposed support members situated between outer side walls.

8. A movable lane blocker merchandising display stand comprising:

a base member;

a plurality of wheels located under said base member to allow movement of said lane blocker merchandising display stand;

an outer shell supported by said base member and having front and side walls and a hollow region between said walls;

an internal support structure disposed within said hollow region and resting on top of said base member; and a plurality of merchandise trays supported by said internal support structure for holding merchandise for display, wherein the merchandise trays are supported by the internal support structure in a stepped configuration and said internal support structure comprises a plurality of shelves for holding said plurality of merchandise trays, and said internal support structure further comprises a lower support structure disposed on top of said base member and an upper support structure supported by said lower support structure and providing said shelves, and wherein said lower support structure comprises vertically disposed members and a cover disposed above said vertically disposed members so that the upper support structure rests on top of the cover.

* * * * *